US006386295B1

(12) United States Patent
Suver

(10) Patent No.: US 6,386,295 B1
(45) Date of Patent: May 14, 2002

(54) VIBRATORY DRIVER FOR PIPE PILING

(76) Inventor: Paul W. Suver, 11025 14th Ave., S. Seattle, WA (US) 98168

( * ) Notice: Subject to any disclaimer, the term of this patent is extended or adjusted under 35 U.S.C. 154(b) by 0 days.

(21) Appl. No.: 09/525,631

(22) Filed: Mar. 10, 2000

(51) Int. Cl.[7] ..... E02D 7/18

(52) U.S. Cl. ..... 173/1; 173/49; 175/55; 405/232

(58) Field of Search ..... 173/1, 49, 132; 405/231, 232; 175/55

(56) References Cited

U.S. PATENT DOCUMENTS

| | | | | | |
|---|---|---|---|---|---|
| 3,917,426 | A | | 11/1975 | Wohlwend et al. | 404/133 |
| 5,117,925 | A | | 6/1992 | White | 173/162.1 |
| 5,263,544 | A | | 11/1993 | White | 173/162.1 |
| 5,544,979 | A | | 8/1996 | White | 405/232 |
| 5,568,997 | A | | 10/1996 | Raunisto | 405/232 |
| 5,609,380 | A | | 3/1997 | White | 294/104 |
| 5,653,556 | A | | 8/1997 | White | 405/249 |
| 5,794,716 | A | * | 8/1998 | White | 173/49 |
| 5,988,297 | A | * | 11/1999 | Zimmerman et al. | 173/1 |
| 6,073,704 | A | * | 6/2000 | Yasuoka et al. | 175/55 |
| 6,129,159 | A | * | 10/2000 | Scott et al. | 173/49 |
| 6,302,222 | B1 | * | 10/2001 | Vessat | 405/232 |

FOREIGN PATENT DOCUMENTS

| | | | |
|---|---|---|---|
| EP | 0 496 167 A1 | 12/1991 | E02D/11/00 |

* cited by examiner

*Primary Examiner*—Scott A. Smith
(74) *Attorney, Agent, or Firm*—Delbert J. Barnard

(57) ABSTRACT

A coupler assembly (46, 48) is suspended from a forward section (12) of a boom (14) that projects from a mobile base (18). An upper end portion (160) of a pipe piling (P) is gripped by a pair of clamp jaws (148, 150). The clamp jaws (148, 150) are movable together and apart and they are mounted for rotation around a common axis. This allows an end portion (160) of a pipe piling (P) to be gripped by the clamp jaws (148, 150) while the pipe piling (P) is in a substantially horizontal or some other non vertical position. Then, the coupler assembly (46, 48) can be lifted to lift the gripped end portion (160) of the pipe piling (P) upwardly. As end portion (160) moves upwardly, the clamp jaws (148, 150) will rotate in position so as to enable the pipe piling (P) to swing upwardly while its lower end is on a support surface. The rotation of the clamp jaws (148, 150) will continue until the pipe piling (P) is suspended from the lifting boom section (12) and is in a substantially vertical orientation.

40 Claims, 6 Drawing Sheets

VIBRATORY DRIVER FOR PIPE PILING

TECHNICAL FIELD

The present invention relates to a vibratory pile driver. More particularly, it relates to the provision of (1) a pile driver that is adapted to be suspended from the boom of an excavator, or some other overhead supporting device, (2) a pile driving machine that includes a mobile base, a boom connected to and extending from the mobile base, (3) a vibrator assembly that is suspended from the boom, and (4) a pile driving method.

BACKGROUND OF THE INVENTION

Known boom supported devices for driving pipe piling and/or other piling are disclosed by: U.S. Pat. No. 5,117,925, granted Jun. 2, 1992, to John L. White; by U.S. Pat. No. 5,263,544, granted Nov. 23, 1993, to John L. White; by U.S. Pat. No. 5,544,979, granted Aug. 13, 1996 to John L. White; by U.S. Pat. No. 5,568,997, granted Oct. 29, 1996, to Yrjö Raunisto; by U.S. Pat. No. 5,609,380, granted Mar. 11, 1997, to John L. White; by U.S. Pat. No. 5,653,556, granted Aug. 5, 1997 to John L. White and by European Patent Publication No. 0 496 167 A1, published Jul. 29, 1992, filed by Kencho Kobe Co., Ltd., the applicant.

There is a need for an improved vibratory pile driver that is relatively simple and easy to operate but yet is effective to drive pipe pilings. There is also a need for a boom supported pile driver that is adapted to easily and quickly pick up a pipe piling, e.g. from a stack on the ground, by a simple lifting of a boom to raise the pipe piling up into a substantially vertical position so that it can be driven into the ground. There is a further need for a pipe piling driving method that provides for quick, easy and simple handling of the pipe piling both before and during the driving operation. It is an object of the present invention to fulfill these needs. It is a further object of the present invention to provide a quick and easy way of coupling the pile driving mechanism to a pipe piling, and then decoupling the mechanism from the pipe piling after the pipe piling has been driven into the ground. Still yet another object of the invention is to provide an improved way of transmitting energy from a vibrator to pipe piling through coupler components that couple the pipe piling to a housing portion of the vibrator.

BRIEF DESCRIPTION OF THE INVENTION

A vibratory pile driver of the present is characterized by a vibrator having an upper portion that is adapted to be connected to a supporting structure that is above the vibrator, and a lower portion. The lower portion of the vibrator includes a chuck assembly that is adapted to be connected to the pipe piling. The chuck assembly includes a coupler or pair of horizontally disposed linear hydraulic actuator. Each actuator comprises a fixed outer end portion and a retractable/extendable/rotatable inner end portion. The chuck assembly also includes pile-engaging clamps at the inner ends of the actuators. The clamps confront each other and are adapted to receive a piling between them. The actuators are adapted to the retracted to move the clamps apart and provide between them a piling receiving space. The actuators can be extended to move the clamps towards each other and into clamping engagement with a piling that has been placed in the space, between the clamps.

According to another aspect of the invention, the vibrator includes a vibrator frame and an elongated first coupler member that has a lower end that is secured to an upper central portion of the vibrator frame. The first coupler member extends upwardly from its connection to the vibrator frame. An elongated second coupler member has an upper end that is adapted to be connected to a supporting structure that is above the vibrator. One of the coupler members is tubular and the other extends inside of it, in telescopic fashion. The tubular coupler member includes a sidewall and at least one longitudinal slot in the sidewall that is closed at both ends. A pin extends laterally of the two coupler members, through the slot in the sidewall of the tubular coupler member, and having an inner end that is connected to the other coupler member.

According to a further aspect of the invention, the chuck assembly or coupler includes chuck frame structure and a pair of horizontal, co-axial, tubular trunnions mounted on the chuck frame structure below the vibrator, for rotation about a horizontal axis. The actuators are inside of the tubular trunnions. The fixed outer end portions of the actuators are connected to the frame structure. The inner end portions of the actuators are connected to the tubular trunnions. In preferred form, the chuck frame structure includes a pair of tubular housings in which the tubular trunnions are received, and further includes a tubular bearing positioned radially between each trunnion and its housing.

According to a further aspect of the invention, the frame structure may include a downwardly opening cup that is above and between the two piling-engaging clamps. The cup is adapted to receive an upper end portion of a piling that is positioned between the two clamps.

According to yet another aspect of the invention, a pile driving machine is provided that includes a mobile base. A boom is provided that has a first end that is connected to the mobile base and a second end that is spaced from the mobile base. The boom is movable relative to the base and the second end of the boom is movable up and down. The pile driving machine further comprises a vibratory pile driver having a vibrator that includes an upper end that is connected to the boom at the second end of the boom, and further has a lower portion that includes a chuck assembly is connected to the lower portion of the vibrator. The chuck assembly includes a pair of horizontally disposed linear hydraulic actuators. Each actuator comprises a fixed outer end portion and a retractable/extendable/rotatable inner end. A pair of piling engaging clamps are connected to the inner end portions of the actuators. The clamps confront each other and are adapted to receive a piling between them. The actuators are retractable to move the clamps apart and provide between them a piling receiving space. They are extendable to move the clamps towards each other and into clamping engagement with a piling that has been placed in the space between the clamps.

According to a further aspect of the invention, the vibrating pile driving attachment is suspended from an outer end portion of a boom but at a location that is inwardly of a bucket or other material handler that is at the extreme end of the boom. This enables the boom to be manipulated for the purpose of positioning the pipe driving attachment and a piling connected thereto, and then be used during the pile driving operation, without a need to remove the bucket or other device from the boom. The bucket is present so that it can be used during the pile driving operation, either for moving material or for supporting the end of the boom during a repositioning of the mobile base on which the boom is supported.

According to still a further aspect of the invention, a pile driving method is provided that includes the step of providing an elongated piling having first and second ends. A pile driver is provided that has a vibrator and laterally spaced apart clamp jaws below the vibrator. The clamp jaws are positioned as to define between them a space for receiving the first end of the piling. The vibrator is then moved to place the first end of the piling between the clamp jaws. Next, the clamp jaws are moved together into a clamping engagement with the first end of the piling. Then, the vibrator and clamp jaws are lifted so as to lift the piling up into a substantially vertical position. The second end of the piling placed on the ground. The vibrator and the clamp jaws are held in a position that maintains the piling in a substantially vertical position. Then, the vibrator is operated to apply a vibration force on the upper end of the piling so as to drive the piling downwardly into the ground. The vibrator and the clamp jaws are lowered as the piling moves downwardly into the ground. The clamp jaws are moved together into a clamping engagement with the first end of the piling when the piling is in a position other than a vertical position, e.g. a horizontal position. The clamp jaws are rotated as the vibrator and the clamp jaws are lifted. The weight of the piling causes the clamp jaws to rotate and follow movement of the piling from its initial position up into a substantially vertical position.

In preferred form, the clamps are provided with a pair of horizontal hydraulic actuators. Each hydraulic actuator has a fixed component and a movable component. The clamp jaws are secured to the movable components. The movable components of the actuators are retracted to move the clamp jaws apart and provide space between them for receiving the first end of the piling. Then, the movable components of the actuators are extended to move the clamp jaws towards each other and into clamping engagement with the piling. In preferred form, the actuators are supported for rotation in response to a force being applied to the clamp jaws that would prompt them to rotate.

According to a further aspect of the invention, the weight of a piling is used to apply a force on the clamping jaws that causes the clamping jaws to rotate in position. The clamping jaws are clamped onto a first end of a piling when the piling is in a position other than a vertical position. For example, it may be lying substantially flat on the ground. The clamping jaws are lifted. In response to their upward movement, and further in response to a force being applied on them by the piling, the clamp jaws will rotate as the piling moves from its initial position into a substantially vertical position.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWINGS

In the drawings, like reference numerals and letters refer to like parts throughout the several views and.

DETAILED DESCRIPTION OF THE INVENTION

Figure 1:
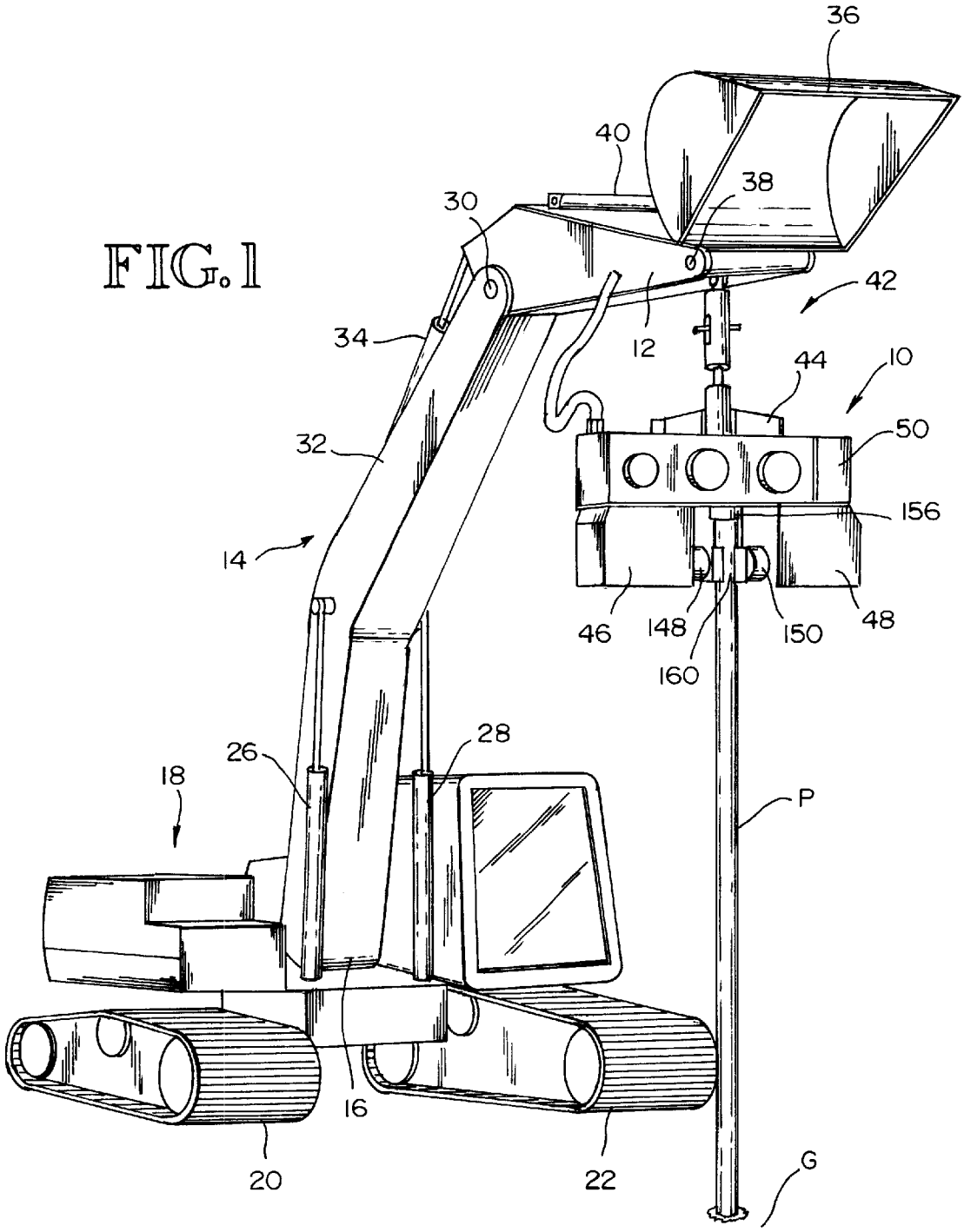
FIG. 1 is a pictorial view of an excavator and a pile driving attachment suspended from the boom of an excavator, such view showing the pile driving attachment in the process of driving a pipe piling into the ground.

Referring to FIG. 1, a vibratory pile driver 10 is shown suspended from a forward section 12 of an articulated boom 14. Boom 14 includes a lower end portion 16 that is pivotally connected in conventional fashion to a mobile base 18. Base 18 may include a pair of laterally spaced apart tracks 20, 22. As is known per se, the tracks 20, 22 may be operated together to move the base 18 forwardly and rearwardly. Or, one track 20, 22 can be rotated in a first direction and the other track 20, 22 can be rotated in the opposite-direction, for turning the base 18. A pair of hydraulic cylinders 26, 28 are interconnected between the base 18 and the boom 14. Extension of the cylinders 26, 28 acts to lift the boom 14. Retraction of the cylinders 26, 28 acts to lower the boom 14. Herein, "lift the boom 14" means swinging it upwardly about its pivotal connection to the base 18. Herein, "lower the boom 14" means swinging the boom downwardly about its pivotal connection to the base 18. Forward section 12 of boom 14 is pivotally connected at 30 to the main portion 32 of the boom 14. A hydraulic cylinder 34 is interconnected between boom forward portion 12 and boom main portion 32. Extension of cylinder 34 causes the forward section 12 to swing downwardly relative to boom section 32. A retraction of cylinder 34 causes the forward section 12 to swing upwardly relative to the boom section 32. Preferably, a bucket 36 or some other material handler is pivotally connected to the forward boom section 12 by a pivot pin 38. A hydraulic cylinder 40 is interconnected between the bucket or other member 36. Extension of cylinder 40 causes the member 36 to swing forwardly. Retraction of cylinder 40 causes the member 36 to swing rearwardly.

According to an aspect of the present invention, the pile driver 10 is suspended from the forward boom section 12. It is connected to the forward boom section 12 by a coupler 42. The upper end of the coupler 42 is attached to the boom section 12 at a location inwardly of the pivot pin 38. The lower end of the coupler 42 is connected to an upper frame portion 44 of the vibrator 10.

Figure 2:
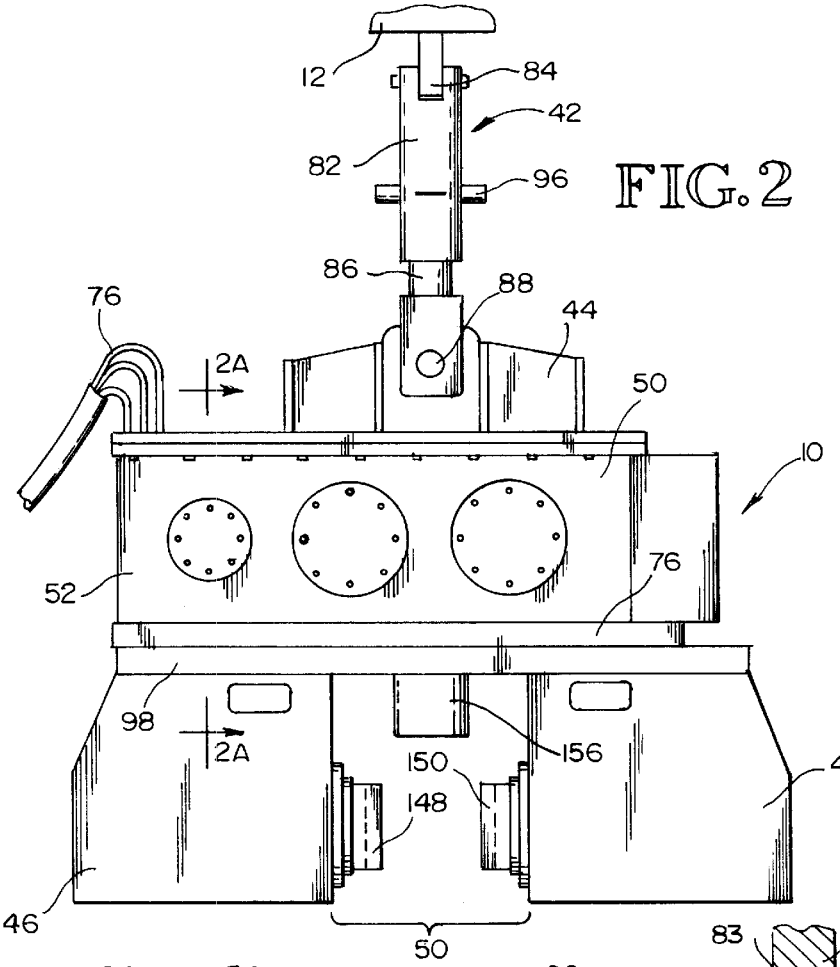
FIG. 2 is an enlarged scale side elevational view of the pile driving attachment, such view showing a coupler above the attachment and a chuck assembly including a cup and a pair of gripping jaws adapted for receiving an upper end portion of a pipe piling.

As best shown by FIG. 2, the vibrator 10 has a two part lower portion 46, 48 which houses a chuck assembly 50. An intermediate section 50 is positioned between the upper frame part 44 and the lower portion 46, 48. Intermediate portion 50 includes a frame or housing portion 52 in which forwarding weights W are located. Housing 52 includes a top wall 54 to which the frame portion 44 is connected. It further includes vertical walls 56, 58, 60, 62. A first weight chamber 64 is defined by and between vertical walls 56, 58. A second weight chamber 66 is defined by and between vertical walls 60, 62. A shaft 68 may extend horizontally through the housing 52 and include the weights W. One weight W is within chamber 64. The other weight W is within chamber 62. The vertical walls 56, 58, 60, 62 include openings in bearings that surround the openings. The bearings support the shaft 68 for rotation. Shaft 68 may also be supported by pillow blocks 70, 72. The weights W may be eccentric weights such as disclosed in U.S. Pat. No. 3,917,426, granted Nov. 4, 1975 to Donald M. Wohlwend and Maurice Wohlwend. In that patent, the eccentric weight is designated (76). Here, one end of shaft 68 is connected to a rotary drive motor 74. In the illustrated embodiment, drive motor 74 is a hydraulic motor. Hoses 76 are shown in FIG. 2 for delivering hydraulic fluid to and from the motor 74. As is well known in the art, rotation of the eccentric weights W will cause the housing 54, 56, 68, 60, 62 to vibrate. This vibration is transmitted by the lower frame portion 76 to the top wall 78 of the assembly 46, 48.

Figure 3:
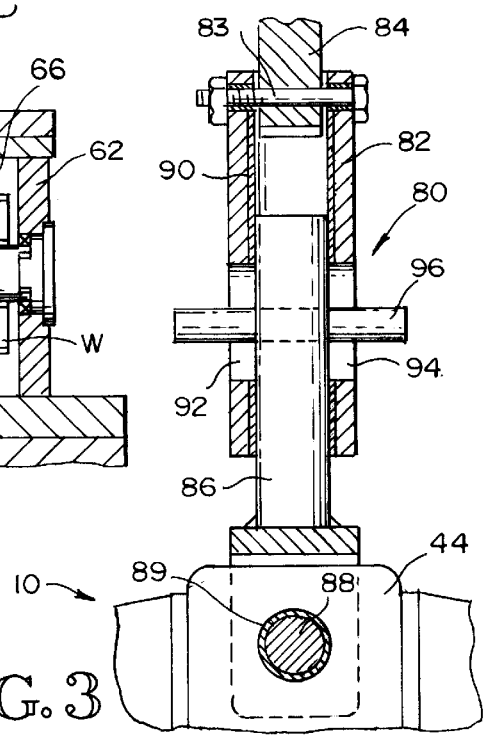
FIG. 3 is an enlarged scale view of the coupler shown in FIG. 2, showing some parts in longitudinal section and some parts in side elevation.

Referring to FIG. 3, in preferred form, the pile driver 10 is connected to the boom section 12 by a two part coupler 80. A first end portion 82 of the coupler 80 may be pivotally connected by a pin 83 to an ear 84 that is provided on a lower portion of the boom section 12. Coupler section 86 is connected at its lower end to the housing portion 44, by a pivot pin 88 that is surrounded by a sleeve bearing 89. Sleeve bearings may surround the pin 83. One of members 82 is tubular. The other is received inside of it, in a telescopic fashion. In the illustrated embodiment, the upper end member 82 is tubular. It is lined by a sleeve 90 of bearing material. The coupler member 86 is in the nature of a rod that is slidably received within the bearing 90. Tubular portion 82 includes a pair of diametrically opposed slots 92, 94. Slots 92, 94 extend longitudinally of the coupler 80. A cross pin 96 extends through both slots 92, 94 and also extends laterally through coupler member 86. The slots 92, 94 are of a width to accommodate the pin 96. Member 86 can move into and out from member 82 within a limit provided by the cross pin 96 and the ends of the slots 92, 94. In FIG. 3, if the boom is raised, the coupler member 82 will move upwardly with it. Member 82 will move relative to member 86 until the lower ends of the slots 92, 94 contact the cross pin 96. Thereafter, any further upward movement of the boom will cause the cross pin 96, the member 86, the pin 88, the frame member 44 and everything below it to move upwardly with the boom. The cross pin 96 will engage the lower ends of the slots 92, 96 and keep the members 82, 86 together and will arrest any further upward movement of 82 relative to member 86. When the boom is lowered, the entire coupler 80, the pin 88 and the frame member 44, and the structure below frame member 44, will move downwardly together with the boom until the lower portions 46, 48 of the pile driver 10 are in some manner stopped, either by contacting the ground or some other support surface, or by a piling P that is coupled to the vibrator 10 having its downward movement arrested by contact with a surface below it that is solid enough to arrest movement of piling P. When downward movement of piling P stops, the further downward movement of coupler member 86 will also stop. Coupler member 82 will continue to move downwardly, however, until the cross pin 96 contacts the upper ends of the slots 92, 94. When this happens, the coupler portion 82 will not move downwardly unless it is able to move downwardly with coupler portion 86, cross pin 96, pin 88, vibrator frame 44, etc. This is because there is contact between the ends of the cross pin 96 and the upper ends of the slots 92, 94. As will be appreciated, a forceful downward movement of the boom can cause the coupler portion 82 to exert a downward force on the cross pin 96 that is sufficient to move the coupler portion 86 and the pin 88 and the vibrator frame 44, and the piling P downwardly, with the piling P moving into the ground.

A feature of the coupler is that it isolates the excavator from the vibration forces.

Figure 2A:
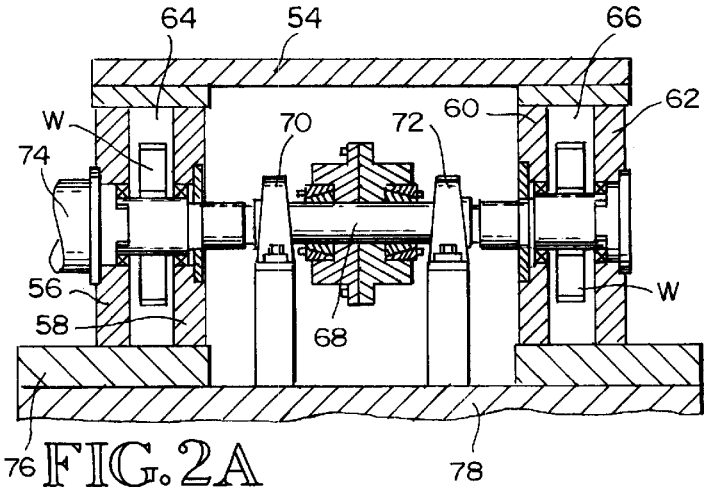
FIG. 2A is an enlarged scale fragmentary view of a central portion of FIG. 2, such view showing a typical use of orbiting weights for providing the vibratory energy.
Figure 4:
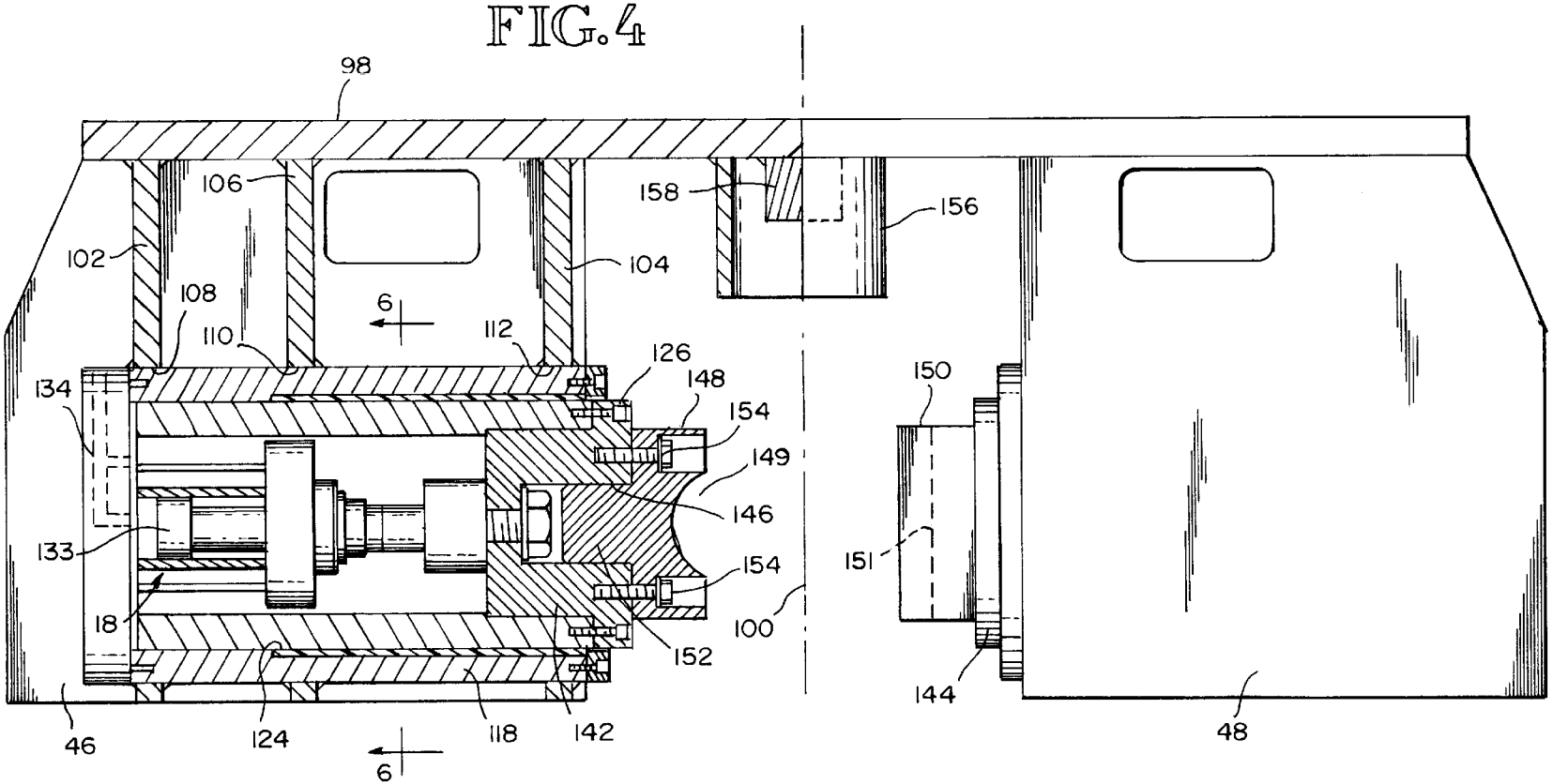
FIG. 4 is an enlarged scale view of the chuck assembly showing some parts in section and other parts in elevation.
Figure 5:
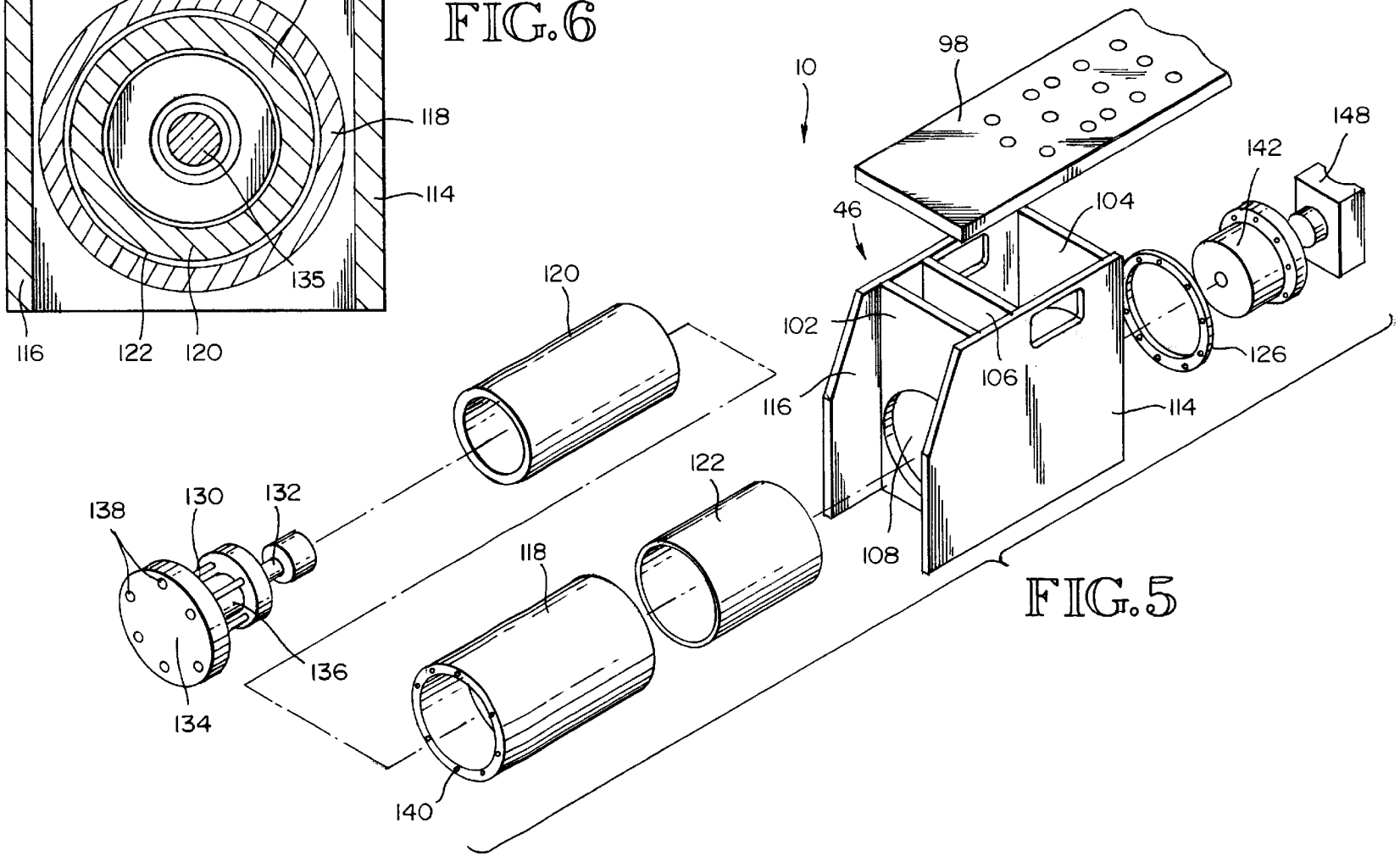
FIG. 5 is an exploded pictorial view of the gripping jaw assembly that is pictured on the left in FIG. 4.
Figure 6:
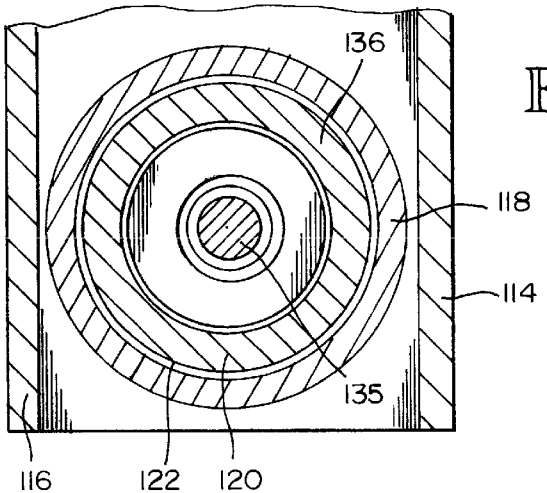
FIG. 6 is a cross sectional view taken substantially along line 6—6 of FIG. 4.

Referring to FIG. 4, a top plate 98 extends horizontally across the upper end of the housing portions 46, 48. Top plate 98 may be secured to the aforementioned plate 76 (FIG. 2A). FIG. 5 is a view of the components of coupler portion 46. It is also a showing of the components of coupler portion 48 as the coupler portions 46, 48 are substantially identical. Each is a mirror image of the other, positioned on an opposite side of a centerline 100. Referring to FIG. 5, coupler portion 46 includes spaced apart end walls 102, 104, and a center wall 106 between them, each of which includes a tube receiving opening, one of which is designated 108 in FIG. 5. Opening 108 is in end wall 102. Like openings 110, 112 (FIG. 4) are provided in end wall 104 and center wall 106. The openings 108, 110, 112 are in coaxial alignment, as shown by FIG. 4. The walls 102, 104, 106 are connected together by sidewalls 114, 116. The openings 108, 110, 112 are sized to receive a tubular housing 118. Once inside the openings 108, 110, 112, the tubular housing 118 is welded to the walls 102, 104, 106, as is shown in FIG. 4. A smaller tubular member 120 fits inside of tubular housing 118. A tubular bearing 122 fits inside of tubular member 118, between it and tubular member 120. As shown in FIG. 4, a substantial portion of the tubular housing 118 may be machined to give it an inner diameter that is larger than the inner diameter of the remaining portion of member 118 and is larger than the outside diameter of tubular member 120. This forms an annular space in which the bearing sleeve 122 is received (FIG. 4). A radial surface or shoulder 124 is formed between the smaller inner diameter portion of tubular member 118, shown on the left in FIG. 4, and the larger inside diameter portion, shown on the right in FIG. 4. The inner end of the tubular bearing 122 abuts this shoulder. A retaining ring 126 abuts the opposite end of the bearing sleeve 122.

A linear hydraulic motor 128 is housed within the tubular housing 120. The hydraulic motor 128 includes an outer end portion 130 and an inner end portion 132. In the illustrated embodiment, the outer end portion 130 is a cylinder. The inner end portion 132 is a piston. Piston 132 includes a piston head 133 within the cylinder 130 and a piston rod 135 that projects from the piston head outwardly from the cylinder. The piston is extendable and retractable relative to the cylinder 130.

As shown by FIGS. 4 and 5, the cylinder includes a radial end wall 134 and a tubular sidewall 136. The end wall 134 is of a diameter substantially equal to the diameter of tubular member 118. It is removably secured to end of tubular member 118 by screw fasteners. The screws extend through screw openings 138 and end wall 134 and screw into threaded openings 140 in the near end of tubular housing 118. The screws secure the end wall 134 to the tubular housing 118, thus fixing the outer end portion 128 of the linear hydraulic motor to a fixed portion of the frame. The inner end portion 132 of the linear hydraulic motor is connected to a head member 142 that in turn is connected to inner end tubular member 120. As a result of this connection, the tubular inner member 120 will extend and retract together with the piston 132 and the member 142. In FIG. 4, the linear hydraulic motor is shown in its fully retracted position. When hydraulic fluid is entered into the base end of the linear hydraulic motor, and removed from the piston rod end, the piston and piston rod will extend. They will move outwardly from the position shown in FIG. 4. The inner tubular housing 120 will move with them because the end member 142 is connected to both the piston rod and the tubular housing 120. As it moves in and out, the tubular housing 120 slides on the bearing sleeve 122. The head member 142 and the tubular inner housing 120 can also rotate in position together with the piston head 133 and the piston rod 135. The piston rod 135 extends out through a seal at the rod end of the cylinder barrel. There is nothing that restrains the piston head 133 and the piston rod 135 from rotating within the cylinder barrel when and if a force is applied on them that would tend to make them rotate.

The above description of coupler end portion 46 applies equally as well to coupler end portion 48. This is because of the fact that the two coupler end portions 46, 48 are identical, as previously described. The coupler portion 48 includes an end member 144 that is like end member 142. The end members 142, 144 include co-axial sockets. The socket in end member 142 is designated 146. The sockets receive pins that are at the inner ends of grip jaws 148, 150. The pin for grip jaw 148 is designated 152 in FIG. 4. The grip jaw pins are inserted into the sockets and then the grip jaws are connected to the heads 142, 144, by means of a series of bolts 154.

As shown by FIGS. 2 and 4, a tubular cup 156 is connected to the plate 98 at a location that is above and between the two jaws 148, 150. A pin 158 is connected to plate 98 inside of the cup 156. Cup 156 extends concentric to the axis 100. Pin 158 also extends from plate 98 concentric with axis 100. The cup 156 receives a first end portion 160 of a pipe piling P. The outside diameter of the pipe piling P fits rather snugly into the inside diameter of the cup 156. The pin 158 fits rather snugly into a center opening that extends through the pipe piling P. Pipe piling P is tubular and includes a sidewall forming and surrounding a center opening that extends axially through the pipe piling P.

Figure 7:
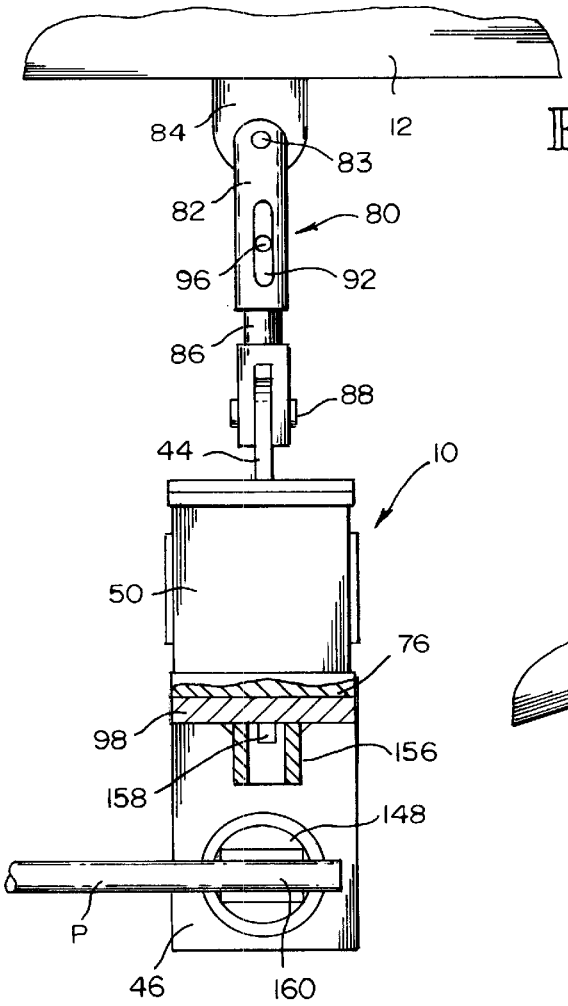
FIG. 7 is a diagrammatic view of the pile driving attachment showing the clamping jaws of the chuck assembly coupled to a pipe piling that is in a horizontal position.
Figure 8:
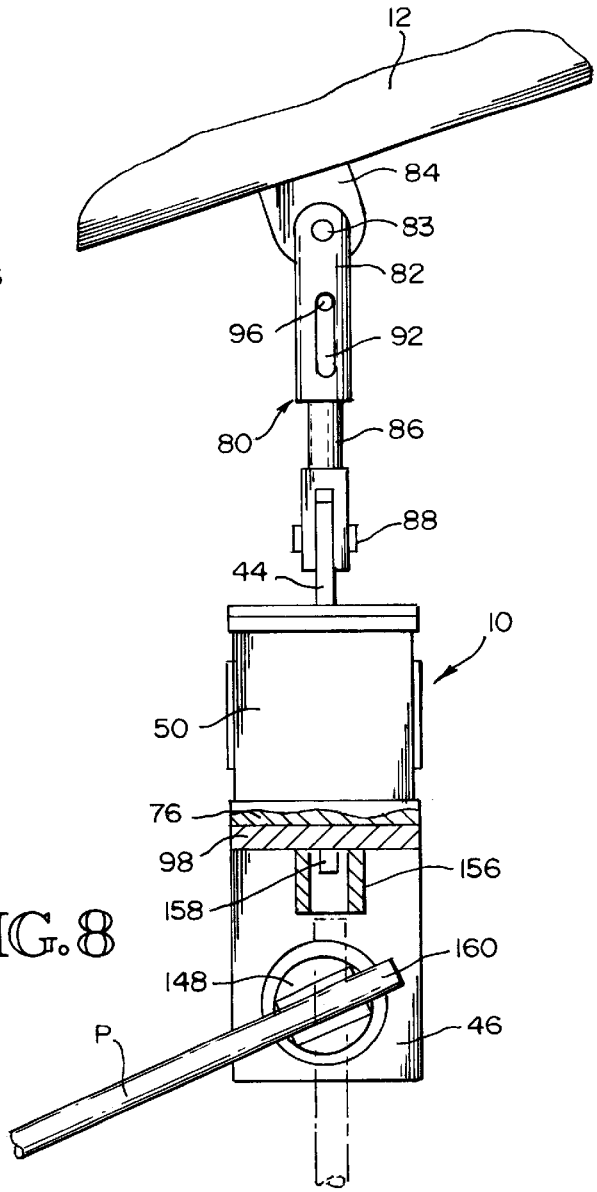
FIG. 8 is a view like FIG. 7 but showing the boom of the excavator and the coupler moved upwardly and further showing the pipe piling in a sloping position and the clamping jaws rotated to permit the position change of the pipe piling.
Figure 9:
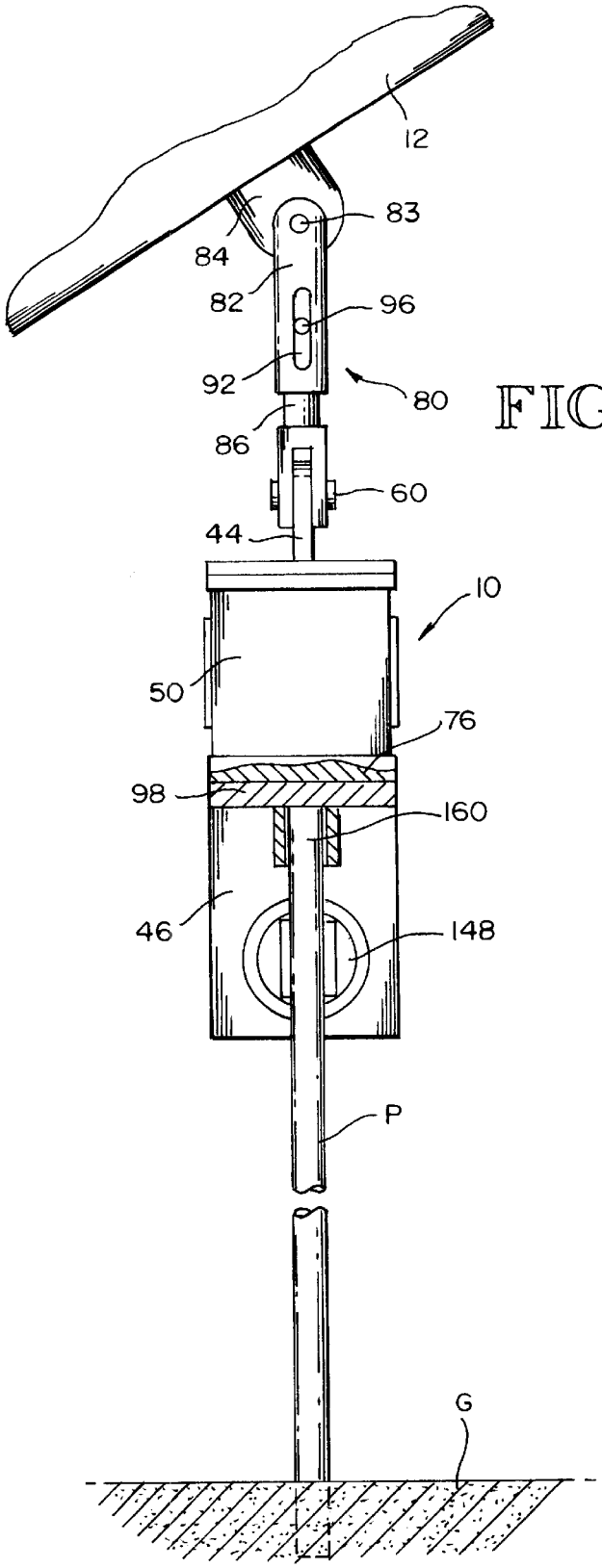
FIG. 9 is a view like FIGS. 7 and 8, but showing the excavator boom in a higher position and showing the pipe piling in a vertical position and moved upwardly to where its upper end is within the cup, and further showing the clamping jaws rotated further to permit the pipe piling to extend vertically.

Referring now to FIGS. 7–9, FIG. 7 shows a pipe piling P in a substantially horizontal position. It also shows an upper end portion 160 of the pipe piling P engaged by clamp jaw 148. It is also engaged by clamp jaw 150 that is not shown in FIGS. 7–9.

It is necessary that end portion 160 of pipe piling P be elevated in some manner. Pipe piling P might be on top of a stack of pipe pilings P. In that case, it may be moved endwise until the end portion 160 is overhanging the rest of the pile or stack. Then, the coupler assembly 46, 48 is lowered until end portion 160 of pipe piling P is between the two jaws 148, 150. Of course, at this time, the hydraulic linear motors are retracted and the jaws 148, 150 are spaced apart so as to define between them a space for receiving the end portion 160 of pipe piling P. Also, the jaws 148, 150 are rotated such that their pipe engaging recesses 149, 151 are parallel to each other and to the pipe piling P. In FIG. 4, jaw 148 and its recess 149 is oriented to engage a pipe piling P that is substantially horizontally oriented. In FIG. 4, the jaw 150 and its recess 151 are oriented to engage the pipe piling P that is substantially vertically oriented. As described above, the jaws 148, 150 are rotatable with the head members 142, 144 and the piston components to which the head members 142, 144 are connected.

The coupler assembly 46, 48 is moved to position the pipe piling end portion 160 in line with the two recesses 149, 151. Then, the linear hydraulic motors 128 are extended to move the jaws 148, 150 together. This moves the recesses 149, 151 into clamping engagement with the pipe piling end portion 160. This is the orientation and relationship that is shown in FIG. 7. Next, the operator lifts the boom section 12 to in turn lift the coupler assembly 46, 48. As the coupler assembly 46, 48 moves upwardly, it moves with it the gripped end portion 160 of the pipe piling P. This lifting of end portion 160 while the opposite end of the pipe piling P remains supported, causes the pipe piling P to move from a substantially horizontal orientation to a sloping orientation. An early stage of the sloping orientation is shown by FIG. 8. Because the clamp jaws 148, 150 are able to rotate, they will rotate as the pipe piling P moves upwardly.

The weight of the pipe piling P will act to hold its second end downwardly while the end portion 160 moves upwardly. The boom 14, and in particular the boom section 12, are moved upwardly until the pipe piling P is in a substantially vertical orientation and is suspended from the clamp jaws 148, 150. Then, the assembly is lowered until the lower end of the pipe piling P is resting on and is supported by the ground. Then, the clamp jaws 148, 150 are retracted slightly so as to allow the piling end portion 160 to move relatively endwise while still within the confines of the clamp jaw recesses 149, 151. Then, the coupler assembly 46, 48 is lowered to allow the piling end portion 160 to enter into positioning cup 156, and allow pin 158 to enter into the open upper end of piling end portion 160. The coupler assembly 46, 48 is moved downwardly until the upper end surface of the pipe piling P is against the plate 98. Then, the linear hydraulic motors are extend to move the clamp jaws 148, 150 back into a gripping engagement with the pipe piling end portion 160. At times it may be desired to loosen the jaws and rotate the pipe P while it is still constrained but not gripped by the jaws.

A particular desirable feature of the coupler 80 is that it holds the assembly in a substantially vertical orientation when the lower end of the pipe piling P is set on the ground and the boom section 12 is moved further downwardly. If a cable or a hook connection were to be used in place of the coupler 80, the structure below frame member 44 would lean sideways in response to the additional lowering of the boom section 12. Instead, when the coupler 80 is used, the lower end of the pipe piling P can be set on the ground and the boom section 12 can be lowered without the coupler assembly 46, 48 and the pipe piling P leaning from vertical any substantial amount. As boom section 12 moves downwardly, the coupler member 86 moves into the coupler member 82. The snug fit of coupler member 86 within the sleeve bearing 90 keeps the two parts 82, 86 of the coupler 80 in alignment. The pivot pins 83, 88 are perpendicular to each other. This acts to prevent pivotal movement at either pivot pin 83, 88. Instead, the entire assembly retains its substantially vertical orientation and the coupler member 86 moves relatively upwardly within the coupler member 82 until the cross pin 96 contacts the upper ends of the guide slots 92, 94. This engagement of the cross pin 96 by the sides of the guide slots 92, 94 also helps to maintain the desired vertical alignment of the structure.

When the structure is in the position shown by FIG. 9, the pile driving operation can begin. Initially, the boom can be swung downwardly to apply a downward endwise force on the coupler assembly 46, 48 and the pipe piling P. If the ground material G is soft, the pipe piling P will move downwardly rather easily and quickly in response to the downward movement of the boom section 12. Because the pivot pin 83 would tend to travel an arcuate path in response to a downward swinging movement of boom section 12, the operator will usually drive the tracks 20, 22 to move the support base 18 rearwardly an amount sufficient to maintain the vertical orientation of the pipe piling P.

When the pipe piling P is moved into the ground G as far as it will go by movement of the boom section 12 alone, the vibrator will be turned on to impose vibratory energy on the upper end portion 160 of the pipe piling P. It is imposed where contact is made between plate 98 and the upper end of the pipe piling P. It is also imposed where the pipe piling end portion 160 is gripped by the clamp jaws 148, 150. The addition of the vibratory energy causes the pipe piling P to resume its downward movement in the ground G. It will be moved until either it stops moving because its lower end contacts solid rock that will not permit it to move any further, or until its upper end portion 160 is near the ground G. Whenever the first situation happens, the linear hydraulic motors are retracted so as to release the grip of the clamp jaws 148, 150 on the piling end portion 160. Then, the pile driver is moved away from the pipe piling P. Then, the pipe piling P is cut off at a desired distance above the ground G. Whenever the second situation happens, the coupler assembly 46, 48 is decoupled from the pipe piling end portion 160 and is moved away from it so that another length of pipe piling P can be added to the pipe piling P that has been sent into the ground G. The pile driver or some other suitable tool can be used to lift up another section P, orient it into a substantially vertical position, and set its lower end on top of the upper end of the buried pipe section P. Then, the two ends of the two pipe sections P can be welded together. Or, a threaded connection can be provided where the two pipe sections P are to be joined and used in lieu of welding. After the new pipe section P has been added, the jaw assembly 46, 48 is moved upwardly and is attached to the upper end of the new pipe piling section P, in the manner described above. Then, the pile driving operation is repeated. This is continued until the assembly of pipe piling sections P has contacted rock and will move no further.

As explained above, some of the vibratory energy is transmitted by the plate 98 to the upper end of the pipe piling P. The downward forces that are imposed on the clamp jaws 148, 150 are transmitted through the tubular members 118, 122, 120. The use of the nesting tubular members 118, 120, 122 also contributes to an effective transmission of the vibratory energy from the frame structure 98, 102, 104, 106, 118, 122, 120, to the head structures 142, 144 and the clamp jaws 148, 150.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A vibratory pile driver, comprising:

a vibrator having an upper portion that is adapted to be connected to a supporting structure that is above the vibrator, and a lower portion; and a chuck assembly connected to the lower portion of the vibrator, said chuck assembly including:

a pair of horizontally disposed linear hydraulic actuators, each said actuator comprising a fixed outer end portion and a retractable/extendable/rotatable inner end portion, and a pair of pile-engaging clamps connected to the inner end portions of the actuators, said clamps confronting each other and being adapted to receive a piling between them, whereby the actuators can be retracted to move the clamps apart and provide between them a piling receiving space, and the actuators can be extended to move the clamps towards each other and into clamping engagement with a piling that has been placed in said space between the clamps.

2. The vibratory pile driver of claim 1, wherein the vibrator includes a vibrator frame, an elongated first coupler member having a lower end that is secured to an upper central portion of the vibrator frame, said first coupler member extending upwardly from its connection to the vibrator frame, and an elongated second coupler member having an upper end that is adapted to be connected to a supporting structure that is above the vibrator, wherein one of the coupler members is tubular and the other coupler member extends inside of it, in telescopic fashion, wherein said tubular coupler member includes a sidewall and a longitudinal slot in said sidewall that is closed at both ends, and a pin extending laterally of the two coupler members, through the slot in the sidewall of the tubular coupler member, and having an inner end that is connected to the other coupler member.

3. The vibratory pile driver of claim 1, wherein the chuck assembly includes chuck frame structure and a pair of horizontal co-axial, tubular trunnions mounted on the chuck frame structure below the vibrator, for rotation about a horizontal axis, wherein the actuators are inside the tubular trunnions, wherein the fixed outer end portion of each actuator is connected to the chuck frame structure, and wherein the inner end portion of each actuator is connected to its tubular trunnion.

4. The vibratory pile driver of claim 3, wherein the chuck frame structure includes a pair of tubular housings in which the tubular trunnions are received, and further includes a bearing positioned radially between each trunnion and its housing.

5. The vibratory pile driver of claim 3, wherein the vibrator includes a vibrator frame, an elongated first coupler member having a lower end that is secured to an upper central portion of the vibrator frame, said first coupler member extending upwardly from its connection to the vibrator frame and an elongated second coupler member having an upper end that is adapted to be pin connected to a supporting structure that is above the vibrator, wherein one of the coupler members is tubular and the other coupler member extends inside of it, in telescopic fashion, wherein said tubular coupler member includes a sidewall and a longitudinal slot in said sidewall that is closed at both ends, and a pin extending laterally of the two coupler members, through the slot in the sidewall of the tubular coupler member, and having an inner end connected to the other coupler member.

6. The vibratory pile driver of claim 5, wherein the chuck frame structure includes a pair of tubular housings in which the tubular trunnions are received, and further includes a bearing positioned radially between each trunnion and its housing.

7. The vibratory pile driver of claim 1, comprising frame structure including a downwardly opening cup above and between the two piling-engaging clamps, said cup being adapted to receive an upper end portion of a piling that is positioned between the two clamps.

8. The vibratory pile driver of claim 7, wherein the vibrator includes a vibrator frame, an elongated first coupler member having a lower end that is secured to an upper central portion of the vibrator frame said first coupler member extending upwardly from its connection to the vibrator frame, and an elongated second coupler member having an upper end that is adapted to be connected to a supporting structure that is above the vibrator, wherein one of the coupler members is tubular and the other coupler member sits inside of it, in telescopic fashion, wherein said tubular coupler member includes a sidewall and a longitudinal slot in said sidewall that is closed at both ends, and a pin extending laterally of the two coupler members, through the slot in the sidewall of the tubular member, and having an inner end that is connected to the other coupler member.

9. The vibratory pile driver of claim 8, wherein said chuck assembly includes chuck frame structure and a pair of horizontal co-axial, tubular trunnions mounted on the chuck frame structure below the vibrator, for rotation about a horizontal axis, wherein the actuators are inside the tubular trunnions, wherein the fixed outer end portion of each actuator is connected to the chuck frame structure, and wherein the inner end portion of each actuator is connected to its tubular trunnion.

10. The vibratory pile driver of claim 9, wherein the chuck frame structure includes a pair of tubular housings in which the tubular trunnions are received, and further includes a bearing positioned radially between said trunnion and the housing.

11. The vibratory pile driver of claim 1, wherein the inner end portion of each said actuator includes an inwardly opening blind socket, and each said clamp includes a pin that is snugly received within the blind socket and a clamp jaw that is connected to said pin and is positioned to confront the clamp jaw for the other actuator of the pair, and wherein each clamp jaw includes a recess for receiving a peripheral portion of a said piling that is positioned between the clamp jaws.

12. The vibratory pile driver of claim 11, wherein the vibrator includes a vibrator frame, an elongated first coupler member having a lower end that is secured to an upper central portion of the vibrator frame, said first coupler member extending upwardly from its connection to the vibrator frame and an elongated second coupler member having an upper end that is adapted to be connected to a supporting structure that is above the vibrator, wherein one of the coupler members is tubular and the other coupler member extends inside of it, in telescopic fashion, wherein said tubular coupler member includes a sidewall and a longitudinal slot in said sidewall that is closed at both ends, and a pin extending laterally of the two coupler members, through the slot in the sidewall of the tubular coupler member, and having an inner end that is connected to the other coupler member.

13. The vibratory pile driver of claim 11, wherein the chuck assembly includes chuck frame structure and a pair of horizontal, co-axial, tubular trunnions mounted on the chuck frame structure below the vibrator, for rotation about a horizontal axis, wherein the actuators are inside the tubular trunnions, wherein the fixed outer end portion of each actuator is connected to the chuck frame structure, and wherein the inner end portion of each actuator is connected to its tubular trunnion.

14. The vibratory pile driver of claim 13, wherein the chuck frame structure includes a pair of tubular housings in which the tubular trunnions are received, and further includes a bearing positioned radially between each trunnion and its housing.

15. The vibratory pile driver of claim 11, comprising frame structure including a downwardly opening cup above and between the two pile-engaging clamps, said cup being adapted to receive an upper end portion of a pile that is positioned between the two clamps.

16. The vibratory pile driver of claim 15, wherein said frame structure is in contact with said vibrator, and wherein said frame structure and said cup are directly vibrated by the vibrator and in turn transmit vibration energy to the upper end of a pile that is within said cup.

17. A pile driving machine, comprising:

a mobile base;

a boom having a first end connected to the mobile base, and a second end spaced from the mobile base, said boom being movable relative to said base and said second end of the boom being movable up and down; and a vibratory pile driver, comprising:

a vibrator having an upper portion that is connected to the boom at said second end of the boom, and further having a lower portion; and a chuck assembly connected to the lower portion of the vibratory, said chuck assembly including:

a pair of horizontally disposed linear hydraulic actuators, each said actuator comprising a fixed outer end portion and a retractable/extendable/rotatable inner end portion, and a pair of piling-engaging clamps connected to the inner end portions of the actuators, said clamps confronting each other and being adapted to receive a piling between them, whereby the actuators can be retracted to move the clamps apart and provide between them a pile receiving space, and the actuators can be extended to move the clamps towards each other and into clamping engagement with a piling that has been placed in said space between the clamps.

18. The driving machine of claim 17, wherein the vibrator includes a vibrator frame, an elongated first coupler member having a lower end that is secured to an upper central portion of the vibrator frame, said first coupler member extending upwardly from its connection to the vibrator frame, and an elongated second coupler member having an upper end that is pin connected to the boom, wherein one of the coupler members is tubular and the other coupler member extends inside of it, in telescopic fashion, and wherein said tubular coupler member includes a sidewall and a longitudinal slot in said sidewall that is closed at both ends, and a pin extending laterally of the two coupler members, through the slot in the sidewall of the tubular coupler member, and having an inner end that is connected to the other coupler member.

19. The pile driving machine of claim 17, wherein the chuck assembly includes chuck frame structure and a pair of horizontal co-axial, tubular trunnions mounted on the chuck frame structure below the vibrator, for rotation about a horizontal axis, wherein the actuators are inside the tubular trunnions, wherein the fixed outer end portion of each actuator is connected to the chuck frame structure, and wherein the inner end portion of each actuator is connected to its tubular trunnion.

20. The pile driving machine of claim 19, wherein the chuck frame structure includes a pair of tubular housings in which the tubular trunnions are received, and further includes a bearing positioned radially between each trunnion and its housing.

21. The pile driving machine of claim 17, comprising frame structure including a downwardly opening cup above and between the two pile-engaging clamps, said cup being adapted to receive an upper end portion of a pile that is positioned between the two clamps.

22. The pile driving machine of claim 21, wherein the vibrator includes a vibrator frame, an elongated first coupler member having a lower end that is secured to an upper central portion of the vibrator frame, said first coupler member extending upwardly from its connection to the vibrator frame, and an elongated second coupler member having an upper end that is pin connected to the boom, wherein one of the coupler members is tubular and the other coupler member fits inside of it, in telescopic fashion, wherein said tubular coupler member includes a sidewall and a longitudinal slot in said sidewall that is closed at both ends, and a pin extending laterally of the two coupler members, through the slot in the sidewall of the tubular member, and having an inner end that is connected to the other coupler member.

23. The pile driving machine of claim 22, wherein said chuck assembly includes chuck frame structure and a pair of horizontal co-axial, tubular trunnions mounted on the chuck frame structure below the vibrator, for rotation about a horizontal axis, wherein the actuators are inside the tubular trunnions, wherein the fixed outer end portion of each actuator is connected to the chuck frame structure, and wherein the inner end portion of each actuator is connected to its tubular trunnion.

24. The pile driving machine of claim 23, wherein the chuck frame structure includes a pair of tubular housings in which the tubular trunnions are received, and further includes a bearing positioned radially between said trunnion and the housing.

25. The pile driving machine of claim 17, wherein the inner end portion of each said actuator includes an inwardly opening blind socket, and each said clamp includes a pin that is snugly received within the blind socket and a clamp jaw that is connected to said pin and is positioned to confront the clamp jaw for the other actuator of the pair, and wherein each clamp jaw includes a recess for receiving a peripheral portion of a said pile that is positioned between the clamp jaws.

26. The pile driving machine of claim 25, wherein the vibrator includes a vibrator frame, an elongated first coupler member having a lower end that is secured to an upper central portion of the vibrator frame, said first coupler member extending upwardly from its connection to the vibrator frame, and an elongated second coupler member having an upper end that is pin connected to the second end of the boom wherein one of the coupler members is tubular and the other coupler member extends inside of it, in telescopic fashion, wherein said tubular coupler member includes a sidewall and a longitudinal slot in said sidewall that is closed at both ends, and a pin extending laterally of the two coupler members, through the slot in the sidewall of the tubular coupler member, and having an inner end that is connected to the other coupler member.

27. The pile driving machine of claim 17, wherein the chuck assembly includes chuck frame structure and a pair of horizontal, co-axial, tubular trunnions mounted on the chuck frame structure below the vibrator, for rotation about a horizontal axis, wherein the actuators are inside the tubular trunnions, wherein the fixed outer end portion of each actuator is connected to the chuck frame structure, and wherein the inner end portion of each actuator is connected to its tubular trunnion.

28. The pile driving machine of claim 27, wherein the chuck frame structure includes a pair of tubular housings in which the tubular trunnions are received, and further includes a bearing positioned radially between each trunnion and its housing.

29. The pile driving machine of claim 17, comprising frame structure including a downwardly opening cup above and between the two piling-engaging clamps, said cup being adapted to receive an upper end portion of a piling that is positioned between the two clamps.

30. The pile driving machine of claim 29, wherein said frame structure is in contact with said vibrator, and wherein said frame structure and said cup are vibrated by the vibrator and in turn transmit vibration energy to the upper end of a piling that is within said cup.

31. The pile driving machine of claim 17, wherein each clamp includes a clamp jaw that confronts the other clamp jaw, and each clamp jaw includes a recess for receiving a peripheral portion of a said piling that is positioned between the clamp jaws, and wherein the clamp jaws are rotatable between a position in which the recesses are substantially horizontal when the vibrator is substantially vertical, and a position in which the recesses are substantially vertical when the vibrator is substantially vertical.

32. The pile driving machine of claim 31, wherein the clamp jaws are secured to the inner end portions of the hydraulic actuators, and wherein the inner end portions of the hydraulic actuators and the jaws rotate together relative to the fixed outer end portions of the hydraulic actuators.

33. The pile driving machine of claim 32, wherein the vibrator includes a vibrator frame, and the pile driving machine includes an elongated first coupler member having a lower end that is secured to an upper central portion of the vibrator frame, said first coupler member extending upwardly from its connection to the vibrator frame, and an elongated second coupler member having an upper end that is pin connected to the boom, wherein one of the coupler members is tubular and the other coupler member extends inside of it, in telescopic fashion, and wherein said tubular coupler member includes a sidewall and a longitudinal slot in said sidewall that is closed at both ends, and a pin extending laterally of the two coupler members, through the slot in the sidewall of the tubular coupler member, and having an inner end that is connected to the other coupler member.

34. The pile driving machine of claim 31, wherein the vibrator includes a vibrator frame, and the pile driving machine includes an elongated first coupler member having a lower end that is secured to an upper central portion of the vibrator frame, said first coupler member extending upwardly from its connection to the vibrator frame, and an elongated second coupler member having an upper end that is pin connected to the boom, wherein one of the coupler members is tubular and the other coupler member extends inside of it, in telescopic fashion, and wherein said tubular coupler member includes a sidewall and a longitudinal slot in said sidewall that is closed at both ends, and a pin extending laterally of the two coupler members, through the slot in the sidewall of the tubular coupler member, and having an inner end that is connected to the other coupler member.

35. A pile driving method, comprising:

providing an elongated piling having first and second ends;

providing a pile driver having a vibrator and laterally spaced apart clamp jaws below the vibrator;

positioning the clamp jaws so as to define between them a space for receiving the first end of the piling;

moving the vibrator to place the first end of the piling between the clamp jaws;

moving the clamp jaws together into a clamping engagement with the first end of the piling;

lifting the vibrator and the clamp jaws so as to lift up the piling, and continuing the lifting until the piling is substantially vertically oriented;

placing the second end of the piling on the ground and holding the vibrator and the clamp jaws in a position that maintains the piling in a substantially vertical position;

providing contact between the vibrator and the first end of the piling, above the clamp jaws; and operating the vibrator to apply a vibration force on the upper end of the piling, so as to drive the piling downwardly into the ground;

lowering the vibrator and the clamp jaws as the piling moves downwardly into the ground;

said method including the clamp jaws together into a clamping engagement with the first end of the piling when the piling is in a position other than a substantially vertical position, and rotating the clamp jaws as the vibrator and the clamp jaws are lifted, and using the weight of the piling to cause the clamp jaws to rotate and follow the movement of the piling from its initial position up into a substantially vertical position.

36. The method of claim 35, comprising providing a pair of horizontal hydraulic actuators, each with a fixed component and a movable component, securing the clamp jaws to the movable component, retracting the movable components of the actuators and the clamp jaws to provide a space between the clamp jaws for receiving the first end of the piling, and extending the movable portions of the actuators to move the clamp jaws into clamping engagement with the piling.

37. The method of claim 36, comprising operating the clamps to clamp onto a first end portion of a piling when the piling is laying on the ground, and then lifting up on the clamp jaws and the piling to lift the first end portion of the piling upwardly and move the piling into a substantially vertical position, attended by rotation of the clamp jaws.

38. The method of claim 35, comprising operating the clamps to clamp onto a first end portion of a piling when the piling is laying on the ground, and then lifting up on the clamp jaws and the piling to lift the first end portion of the piling upwardly and move the piling into a substantially vertical position, attended by rotation of the clamp jaws.

39. The method of claim 35, comprising providing a vehicle that includes a mobile base and a boom pivotally attached at one end to the mobile base and extending from the mobile base to an opposite second end, and connecting the pile driver to the second end of the boom and using the boom to lift and position the pile driver and any piling connected to it.

40. The pile driving method of claim 39, comprising providing the outer end of the boom with an attachment for handling material, and coupling the pile driver to the boom at a location near the outer end of the boom spaced inwardly from such attachment, and raising the attachment into a position above the vibrator such that it remains on the boom but is in a position where it will not interfere with the operation of the vibrator.

* * * * *